US008491318B2

(12) United States Patent
Lee et al.

(10) Patent No.: US 8,491,318 B2
(45) Date of Patent: Jul. 23, 2013

(54) THIN SOCKET

(75) Inventors: Yu-Lung Lee, New Taipei (TW); Jung-Hui Hsu, New Taipei (TW); Ming-Chou Kuo, Taipei (TW); Yu Hsuan Chen, New Taipei (TW)

(73) Assignee: Powertech Industrial Co., Ltd., New Taipei (TW)

( * ) Notice: Subject to any disclaimer, the term of this patent is extended or adjusted under 35 U.S.C. 154(b) by 0 days.

(21) Appl. No.: 13/298,329

(22) Filed: Nov. 17, 2011

(65) Prior Publication Data

US 2012/0258632 A1 Oct. 11, 2012

(30) Foreign Application Priority Data

Apr. 8, 2011 (TW) ..... 100112345 A

(51) Int. Cl.
*H01R 13/44* (2006.01)

(52) U.S. Cl.
USPC ..... 439/131; 439/651

(58) Field of Classification Search
USPC ..... 439/131, 651, 640, 650, 214, 140, 439/141
See application file for complete search history.

(56) References Cited

U.S. PATENT DOCUMENTS

| | | | | | |
|---|---|---|---|---|---|
| 3,458,794 | A * | 7/1969 | Bohnstedt et al. | ..... | 320/111 |
| 4,059,321 | A * | 11/1977 | Rasmussen et al. | ..... | 439/131 |
| 5,160,879 | A * | 11/1992 | Tortola et al. | ..... | 320/111 |
| 6,179,633 | B1 * | 1/2001 | Inada | ..... | 439/131 |
| 6,179,665 | B1 * | 1/2001 | Rossman et al. | ..... | 439/654 |
| 6,872,086 | B2 * | 3/2005 | Milan | ..... | 439/131 |
| 7,934,932 | B1 * | 5/2011 | Lee et al. | ..... | 439/31 |
| 8,182,274 | B1 * | 5/2012 | Cheng et al. | ..... | 439/131 |
| 2004/0142587 | A1 * | 7/2004 | Milan | ..... | 439/131 |
| 2004/0147147 | A1 * | 7/2004 | Griepentrog | ..... | 439/131 |
| 2004/0209500 | A1 * | 10/2004 | Chang | ..... | 439/131 |

* cited by examiner

*Primary Examiner* — Gary F. Paumen
(74) *Attorney, Agent, or Firm* — Li & Cai Intellectual Property (USA) Office

(57) ABSTRACT

A thin socket allowing reception of a power source through a power source input interface, said thin socket comprising a first case, a second case, a plurality of metal clamping parts and a movable part. The second case and the first case conjunctively form a first accommodating space and the movable part is movably embedded into the first accommodating space or protrudes out of the first accommodating space. The first case has a plurality of holes used for insertion of a plurality of conductive terminals in a plug. The second case has an opening whose position on the second case corresponds to the positions of the plurality of holes on the first case. The movable part movably passes through the opening on the second case and has a second accommodating space.

19 Claims, 10 Drawing Sheets

THIN SOCKET

BACKGROUND OF THE INVENTION

1. Field of the Invention

The present invention relates to a power source socket; in particular, it relates to a thin socket of reduced size.

2. Description of Related Art

Refer initially to FIG. 1, wherein a general socket 11 is shown, comprising a case 111, a power source input interface 113 and a plurality of holes 115 allowing insertion of a plug 13 from an electronic product, which plug 13 including multiple conductive terminals 133 protruding from the insulating portion 131. The thickness $t_1$ of the case 111 conforms to the length $t_3$ of the conductive terminal 133 in the plug 13 so as to provide the conductive terminals 133 with secured insulation protection under conducting condition thereby ensuring safety of users in using the electronic product.

The length $t_3$ of a common conductive terminal 133 usually ranges from 1.5~2 centimeters (cm), so that the thickness $t_1$ of the case 111 of the socket 11 needs to be greater than or equal to $t_3$, for example 2 cm or more; accordingly, the case 111 may be of significant size which occupies indoor space, adversely affects landscape aesthetics and causes an issue of reduced user portability as well.

SUMMARY OF THE INVENTION

The issue to which the present invention is addressed lies in that, since the prior art socket is generally characterized in excessive thickness thus undesirably occupying significant space, the present invention provides a thin socket featuring a movable part of extensibility thereby enabling enhanced user portability or convenient accommodation.

The thin socket according to the embodiments of the present invention offers an extensible movable part which can ascend upon insertion of the conductive terminals into the holes so as to protect the conductive terminals; while the conductive terminals are pulled off from the holes, the movable part is lowered and embedded into the case of the thin socket thereby achieving the design requirement on thin case.

In order to further appreciate the characteristics and technical contents of the present invention, references are made to the details descriptions of the present invention as well as appended drawings therein; but, however, all such inventive details descriptions and appended drawings are merely illustrative rather than being intended to limit the claimed scope thereof in any aspect.

DETAILED DESCRIPTION OF THE PREFERRED EMBODIMENTS

The specification of the present invention discloses a thin socket applicable to an extension line socket, a hole expansion socket or a charger socket and the like, comprising an extensible movable part installed on one side of the case opposite to the holes, and using the conductive terminals and a ground terminal of the plug to reach and press against the movable part to ascend thereby accommodating the conductive terminals and the ground terminal within the movable part and case.

Figure 1:
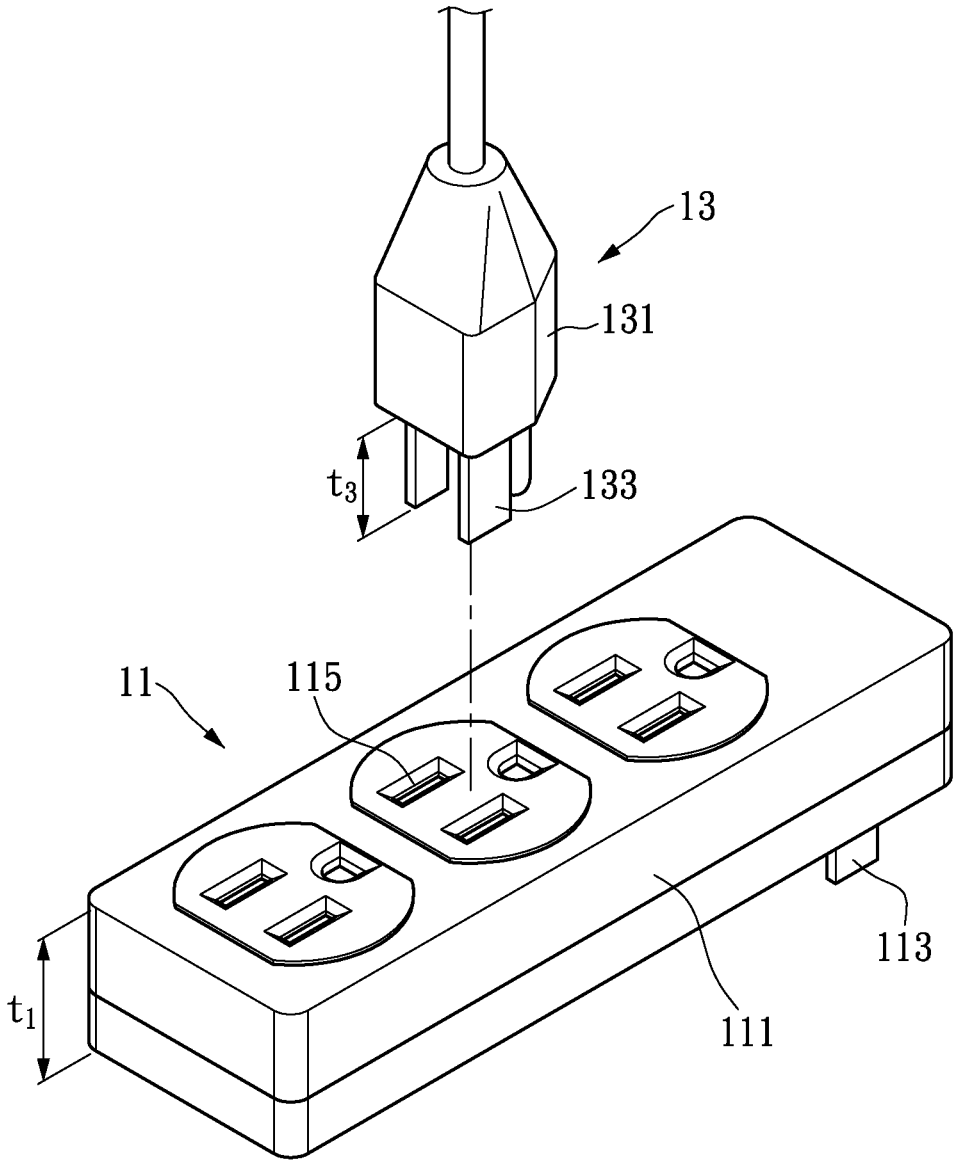
FIG. 1 PRIOR ART
FIG. 1 shows a diagram of a prior art socket.
Figure 2A:
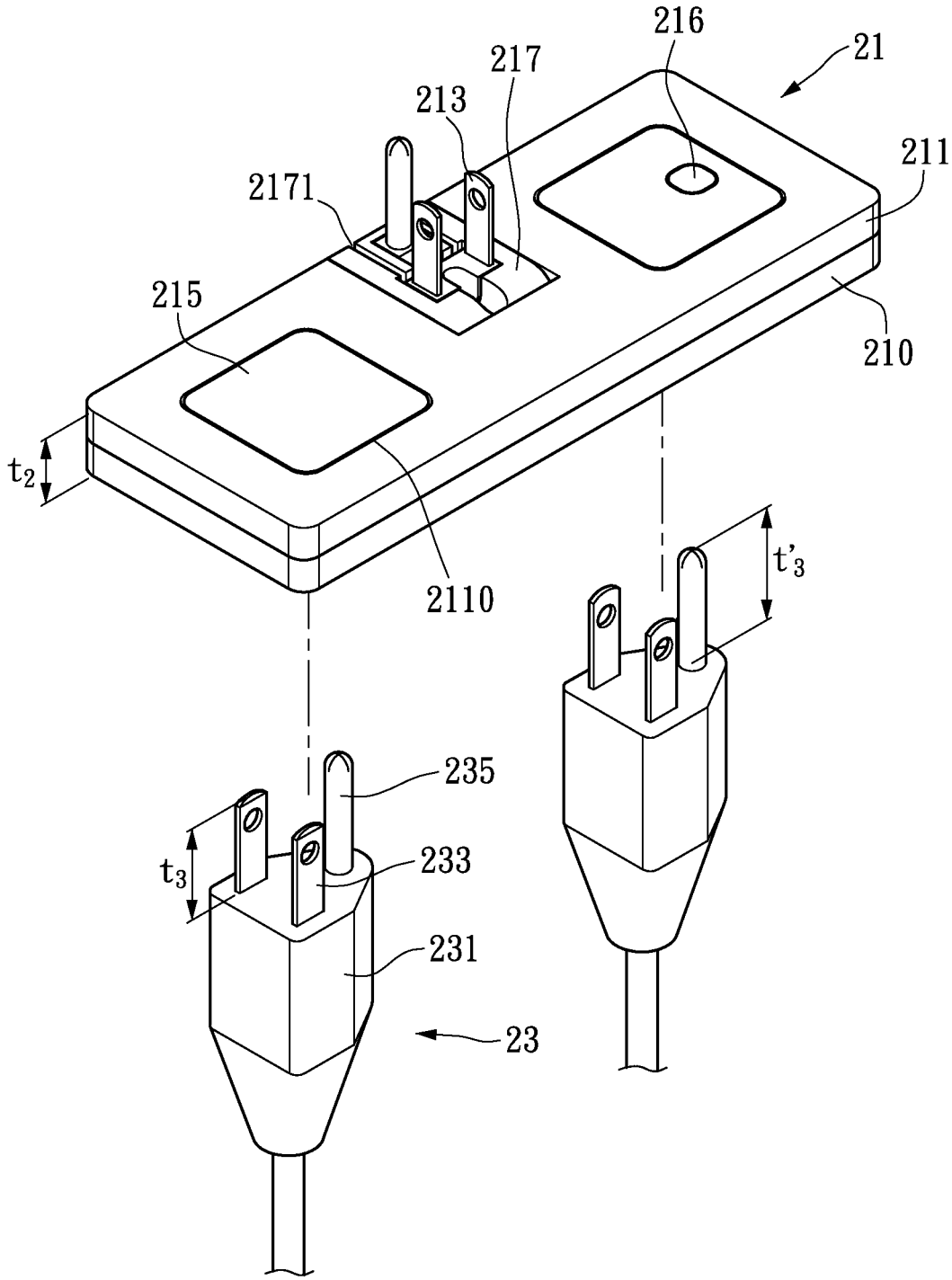
FIGS. 2A to 2B show diagrams for an embodiment of the thin socket according to the present invention.

Refer now to FIG. 2A, wherein a diagram of a thin socket according to an embodiment of the present invention is shown. As depicted, the thin socket 21 comprises a first case 210, a second case 211, a power source input interface 213, a movable part 215 and an insulating terminal base 217. Herein the first case 210 and the second case 211 can be mutually jointed, the movable 215 is installed on the second case 211, the insulating terminal base 217 is pivotally installed on the first case 210 and the second case 211, and the power source input interface 213 is pivotally installed on the insulating terminal base 217.

The first case 210 has at least one set of holes, with each set of holes comprising multiple holes (not shown) for insertion of the plug 23, and the second case 211 has an opening 2110 which is located at a position on the second case 211 corresponding to the position of the multiple holes on the first case 210; i.e., such holes and the opening 2110 are installed on the same axis. Herein the first case 210 and the second case 211 may be two independent cases and assembled together through locks, clips, adhesions or any other suitable means, while the present invention is not limited thereto. In practice, the first case 210 and the second case 211 may be further respectively an upper surface and a lower surface of a single piece case. Therefore, the spirit of the present invention in terms of the first case 210 and the second case 211 exists in forming a hollow space there between by mutually contacting the first case 210 with the second case 211, and those skilled ones in the art can of course arbitrarily modify or alter the fabrication or assembly approach for the first case 210 and the second case 211 without departing from the scope of the present invention.

The power source input interface 213 can be a plurality of conductive pins or a wire plug for inserting into a wall socket (not shown) in order to receive a power source; in the present embodiment, the power source input interface 213 is exemplarily illustrated as a plurality of conductive pins, and the insulating terminal base 217 includes multiple recesses 2171 used to accommodate the power source input interface 213.

The thin socket 21 shown in FIG. 2A is in an inactive state and, in practice, the total thickness $t_2$ of the first case 210 and the second case 211 is approximately less than or equal to the length $t_3$ of the plurality of conductive terminals 233 and the length $t'_3$ of the ground terminal 235 protruding from the insulating portion 231, wherein the movable part 215 can be embedded into the opening 2110, the insulating terminal base 217 can be formed as a single piece along with the first case 210 and the second case 211, and the power source input interface 213 can be received within the recess 2171 thereby preventing the protrusive power source input interface 213 from tangling with external power lines or scratching other items. In this way, the thin socket 21 according to the present embodiment provides a flat, smooth and slim appearance.

Figure 2B:
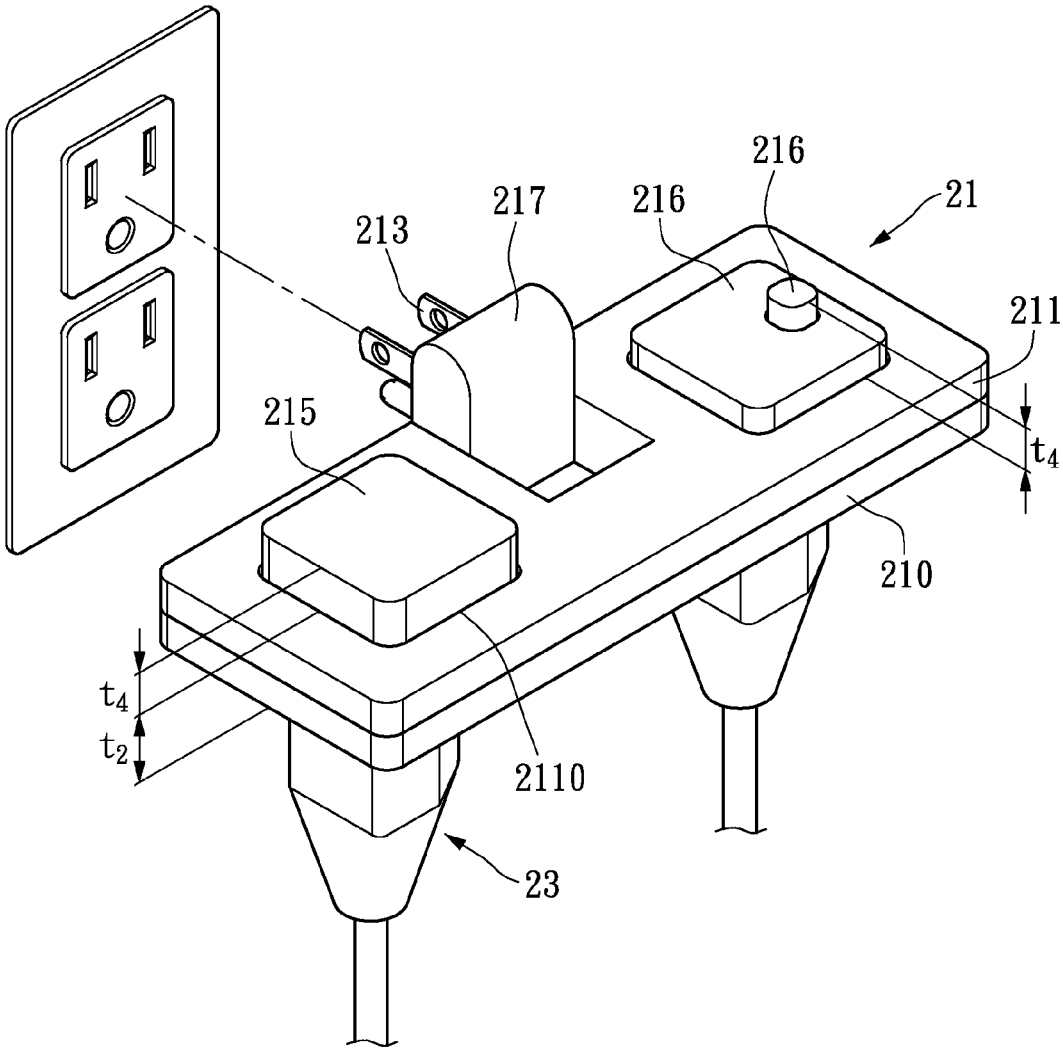

Refer next to FIG. 2B, wherein a diagram of a thin socket according to an embodiment of the present invention is shown. As shown in FIG. 2B, in using the thin socket 21, the insulating terminal base 217 can construct an angle, 90° for example, with respect to the first case 210 and the second case 211 through rotation; meanwhile, the power source input interface 213 can be rotated to be vertically inserted onto the insulating terminal base 217 thus accordingly plugged into a wall socket (not shown).

In practice, the length $t'_3$ of the ground terminal 235 is usually greater than the length $t_3$ of the plurality of conductive terminals 233. Upon insertion of the plug 23 into the holes on the first case 210, the movable part 215 can be reached and pressed by the ground terminal 235 in the plug 23 to protrude out of the second case 211. In practice, the sum of the thickness $t_4$ of the protrusive movable part 215 and the total thickness $t_2$ of the first case 210 and the second case 211, i.e., $(t_2+t_4)$, is roughly greater than or equal to the length $t'_3$ of the ground terminal 235. Besides, when the length $t'_3$ of the ground terminal 235 is substantially the same as the length $t_3$ of the plurality of conductive terminals 233, the movable part 215 can, of course, be reached and pressed by the plurality of conductive terminals 233.

In one embodiment, the first case 210 of the thin socket 21 includes multiple sets of holes and the second case 211 of the thin socket 21 also includes the same number of multiple openings 2110 and multiple movable parts 215, 216 as such multiple sets of holes on the first case 210, with corresponding number and positions thereof, as shown in FIG. 2B, wherein the movable part 215 may include one single movable cover, or alternatively also include a combination of one movable cover together with plural sleeves so as to achieve the effect of multi-sectioned extension.

In the following descriptions the ways that embodiments of the present invention apply to cause the movable part to ascend and descend in the opening will be further discussed.

First Embodiment

Figure 3A:
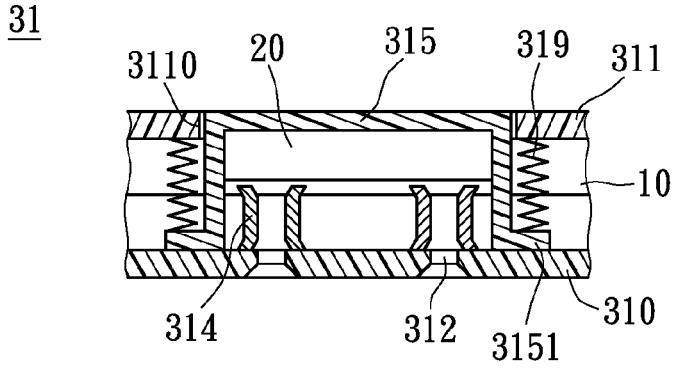
FIGS. 3A to 3B show cross-section views for a first embodiment of the thin socket according to the present invention.
Figure 3B:
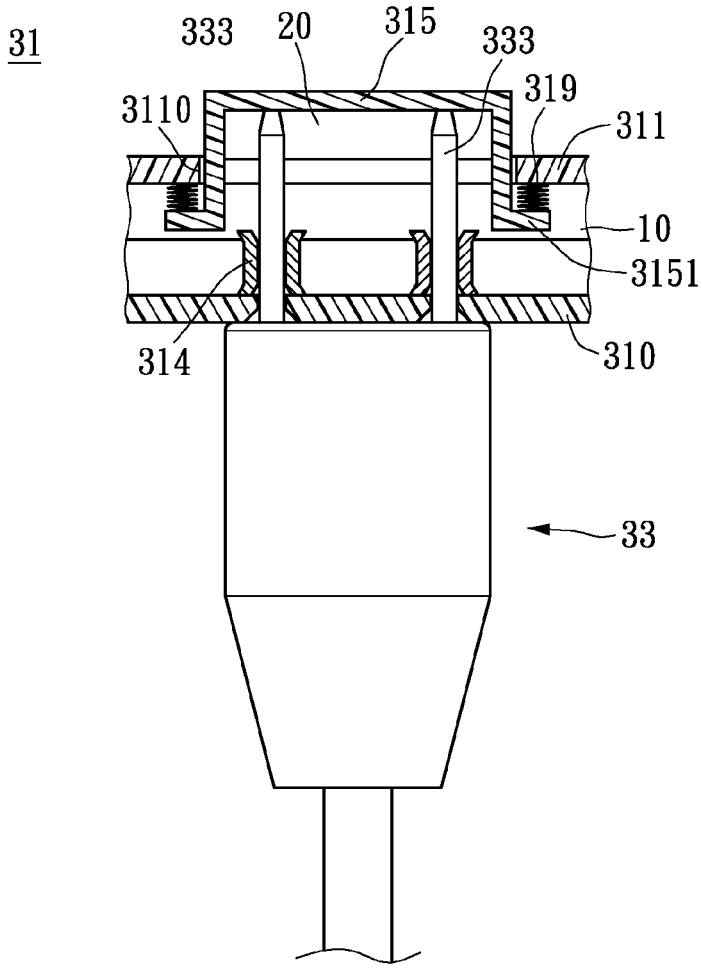

Refer to FIGS. 3A to 3B, wherein cross-section views for a first embodiment of the thin socket according to the present invention are shown. As depicted in FIG. 3A, the thin socket 31 comprises a first case 310, a second case 311, a plurality of metal clamping parts 314, a movable part 315 and an elastic component 319.

The first case 310 and the second case 311 in the thin socket 31 are opposite to each other, with the first accommodating space 10 formed between the first case 310 and the second case 311. The first case 310 includes a plurality of holes 312, and the second case 311 includes an opening 3110 whose position on the second case 311 corresponds to the position of the plurality of holes 312 on the first case 310. The plurality of metal clamping parts 314 are received within the first accommodating space 10 and adjacent to the plurality of holes 312 for clamping the multiple conductive terminals 333 of the plug 33, and the plurality of metal clamping parts 314 are respectively coupled to the power source input interface (not shown) such that the power source input interface is electrically connected to such multiple conductive terminals 333. In practice, the plurality of metal clamping parts 314 can be fixed onto the first case 310 by means of adhesion or welding.

The movable part 315 includes a second accommodating space 20 for receiving the plurality of metal clamping parts 314 and can optionally protrude out of the opening 3110 or otherwise be embedded into the first accommodating space 10. A blocking portion 3151 can be configured on the exterior periphery of the movable part 315; in practice, such a blocking portion 3151 may be located on the exterior periphery of the bottom side in the movable part 315 and the outer diameter of the blocking portion 3151 is greater than the size of the opening 3110 such that the blocking portion 3151 moves along with the movable part 315, located within the first accommodating space 10 and blocked on the second case 311 or the first case 310 around the opening 3110.

In an embodiment, the elastic component 319 is installed between the blocking portion 3151 and the second case 311, and can be used to support the blocking portion 3151 so as to press against the interior side of the first case 310. As shown in FIG. 3A, when the plurality of conductive terminals 333 are not inserted in the multiple holes 312, the movable part 315 is accommodated within the first accommodating space 10, and the multiple metal clamping parts 314 are received inside the second accommodating space 20 which is connected to the multiple holes 312.

On the other hand, as shown in FIG. 3B, in case that the plurality of conductive terminals 333 are inserted in the multiple holes 312 and fixedly clamped by the metal clamping parts 314, such plurality of conductive terminals 333 can reach and press against the inner side of the movable part 315 such that the movable part 315 protrudes out of the opening 3110, in which the second accommodating space 20 and the first accommodating space 10 become connected and the plurality of conductive terminals 333 can be entirely received within the first accommodating space 10 and the second accommodating space 20.

As the movable part 315 moves toward the outside of the opening 3110 along the insertion direction of the conductive terminals 333, the elastic component 319 is compressed by the blocking portion 3151 and the second case 311; while the conductive terminals 333 are unplugged from the holes 312, the elastic component 319 accordingly provides a compressed restoring force to make the movable part 315 return to the inside of the first accommodating space 10. In practice, the friction force allowing the metal clamping parts 314 to hold the conductive terminals 333 in fixation is greater than the compressed restoring force provided by the elastic component 319 thereby preventing the conductive terminals 333 from falling off during insertion in the holes 312.

In the present embodiment, the use of the elastic component 319 can be suitably omitted; that is, the movable part 315 can be pushed by the conductive terminals 333 to ascend, and, as the conductive terminals 333 being pulled out of the holes 312, it is possible to manually press down the movable part 315 thus restoring it to the inside of the first accommodating space 10.

Second Embodiment

Figure 4A:
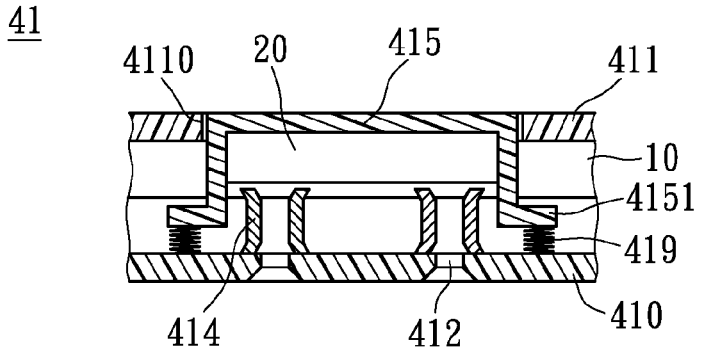
FIGS. 4A to 4B show cross-section views for a second embodiment of the thin socket according to the present invention.
Figure 4B:
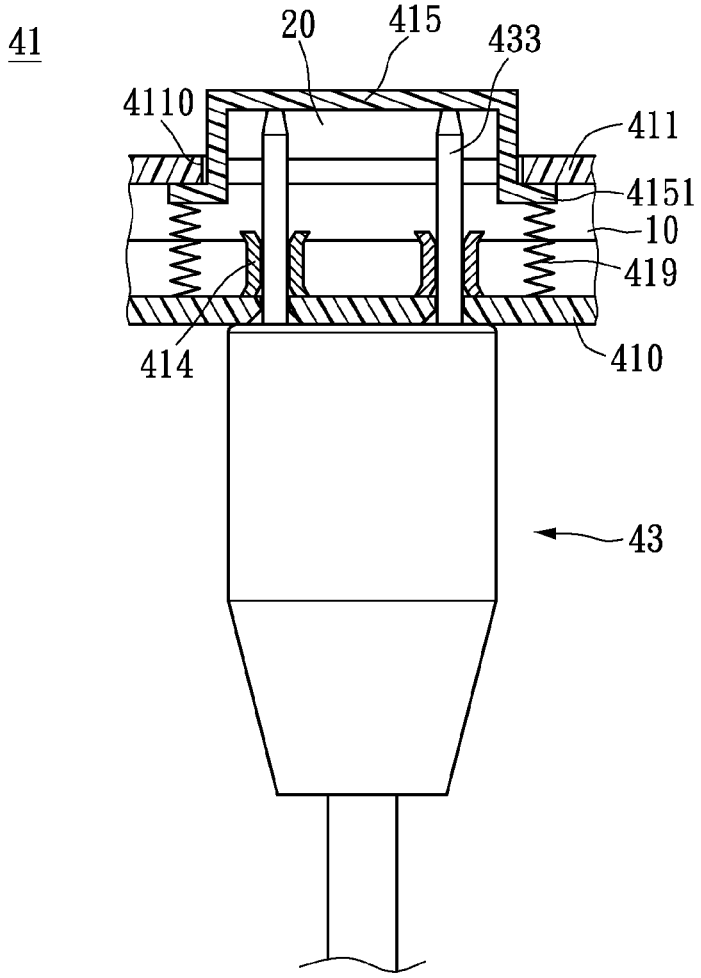

Refer now to FIGS. 4A to 4B, wherein cross-section views for a second embodiment of the thin socket according to the present invention are shown. As depicted in FIG. 4A, the thin socket 41 in the second embodiment is generally similar to the thin socket 31 illustrated in the first embodiment; in other word, the thin socket 41 comprises a first case 410, a second case 411, a plurality of metal clamping parts 414, a movable part 415 and an elastic component 419. The difference between them, however, lies in that the elastic component 419 of the thin socket 41 is installed between the blocking portion 4151 and the first case 410 and connects respectively the blocking portion 4151 and the first case 410.

As shown in FIG. 4A, when the conductive terminals 433 of the plug 43 is not inserted in the holes 412, the elastic component 413 is used to maintain a gap between the blocking portion 4151 and the first case 410 and allows the movable part 415 to remain within the first space 10.

On the other hand, as shown in FIG. 4B, in case that the plurality of conductive terminals 433 are inserted in the holes 412 and fixedly clamped by the metal clamping parts 414, such plurality of conductive terminals 433 can reach and press against the inner side of the movable part 415 such that the movable part 415 protrudes out of the opening 4110, in which the second accommodating space 20 and the first accommodating space 10 are connected and the plurality of conductive terminals 433 can be entirely received within the first accommodating space 10 and the second accommodating space 20.

As the movable part 415 moves toward the outside of the opening 4110 along the insertion direction of the conductive terminals 433, the elastic component 419 is pulled by the blocking portion 4151 and the second case 410; while the conductive terminals 433 are unplugged from the holes 412, the elastic component 419 accordingly provides a tensile restoring force to make the movable part 415 return to the inside of the first accommodating space 10. In practice, the friction force allowing the metal clamping parts 414 to hold the conductive terminals 333 in fixation is greater than the tensile restoring force provided by the elastic component 419 thereby preventing the conductive terminals 433 from falling off during insertion in the holes 412.

As such, when the conductive terminals 433 are not plugged in the holes 412, the movable part 415 can be embedded within the first case 410 and the second case 411 thus allowing the thickness of the thin socket 41 to be smaller than a general socket for convenient accommodation.

Third Embodiment

Figure 5A:
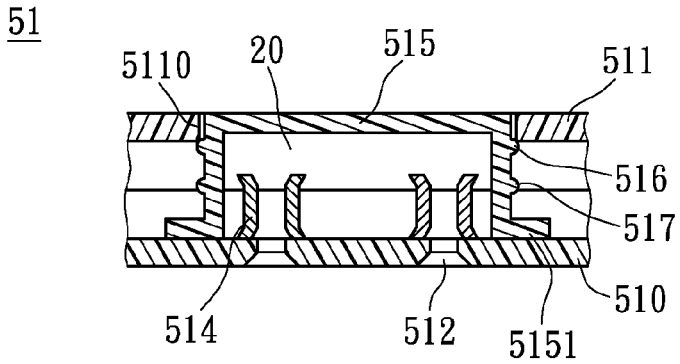
FIGS. 5A to 5B show cross-section views for a third embodiment of the thin socket according to the present invention.
Figure 5B:
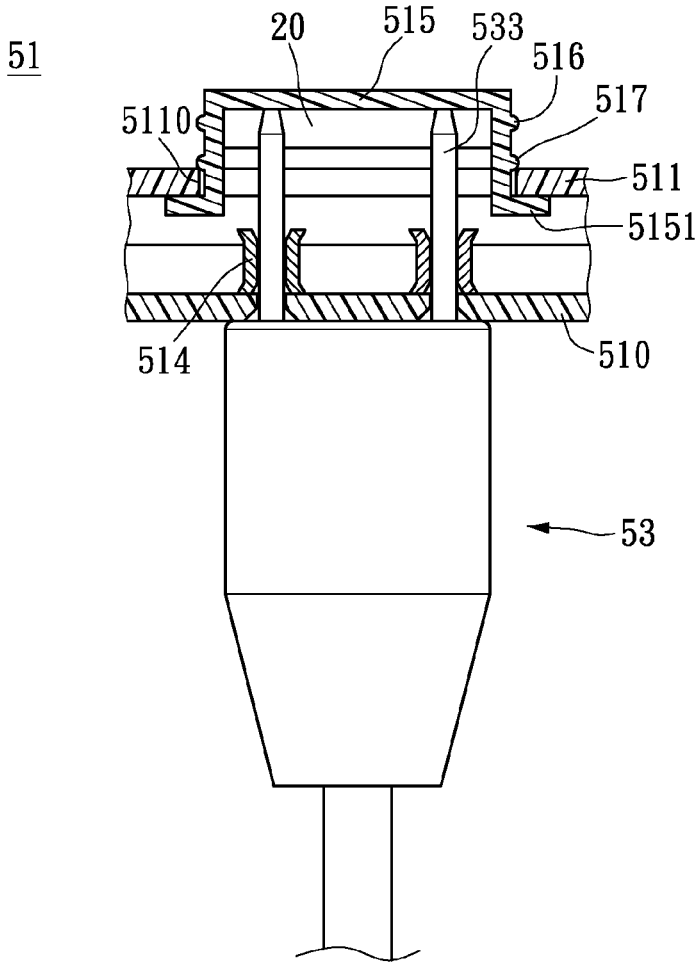

Refer next to FIGS. 5A to 5B, wherein cross-section views for a third embodiment of the thin socket according to the present invention are shown. As depicted in FIG. 5A, the thin socket 51 in the third embodiment is generally similar to the thin socket 31 illustrated in the first embodiment; in other word, the thin socket 51 comprises a first case 510, a second case 511, a plurality of metal clamping parts 514 and a movable part 515. The difference between them lies in that the thin socket 51 of the third embodiment does not comprise the elastic component, but includes the bumps 516, 517 on the exterior periphery of the movable part 515 in order to keep the movable part 515 being positioned within the first accommodating space 10 or on the opening 5110.

As shown in FIG. 5, when the conductive terminals 533 of the plug 53 are not inserted into the holes 512, the movable part 515 is embedded in the first accommodating space 10 and is fixedly received within the first accommodating space 10 through clipping the bump 516 to the second case 511.

As shown in FIG. 5B, when the conductive terminals 533 are inserted in the holes 512 and clamped by the metal clamping parts 514, the conductive terminals 533 reach and press against the inner side of the movable part 515 such that the movable part 515 protrudes out of the opening 5110; at this moment, the bumps 516, 517 provide a resistive force against the passing of the movable 515 through the opening 5110 until the second accommodating space 20 and the first accommodating space 10 become mutually connected, in which the conductive terminals 433 are entirely received within the first accommodating space 10 and the second accommodating space 20 and the bump 517 is clipped on the external side of the second case 511 thereby allowing to fixedly locate the movable part 515 onto the opening 5100.

Upon that the movable part 515 moves toward the outside of the opening 5110 along the insertion direction of the conductive terminals 533, the bumps 516, 517 pass through the opening 5110 and protrude out of it, thus restricting the blocking portion 5151 on the second case 511. The difference between the first embodiment and the third embodiment lies in that, the movable part 515 in the thin socket 51 is not subject to the elastic force (either compressed restoring force or tensile restoring force) enabling restoration into the first accommodating space 10; rather, when the conductive terminals 533 are pulled off from the holes 512, the user can manually press down the movable part 515 to return it into the first accommodating space 10.

Fourth Embodiment

Figure 6A:
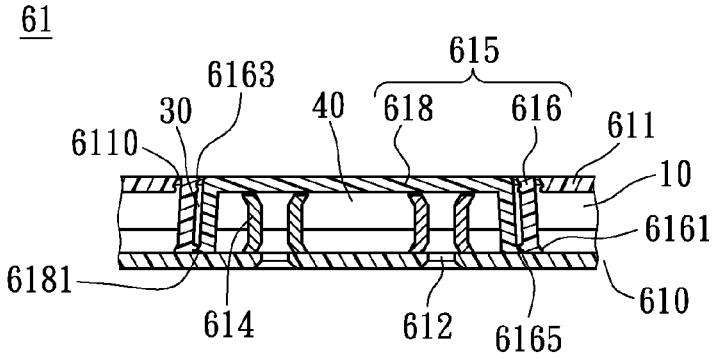
FIGS. 6A to 6B show cross-section views for a fourth embodiment of the thin socket according to the present invention.
Figure 6B:
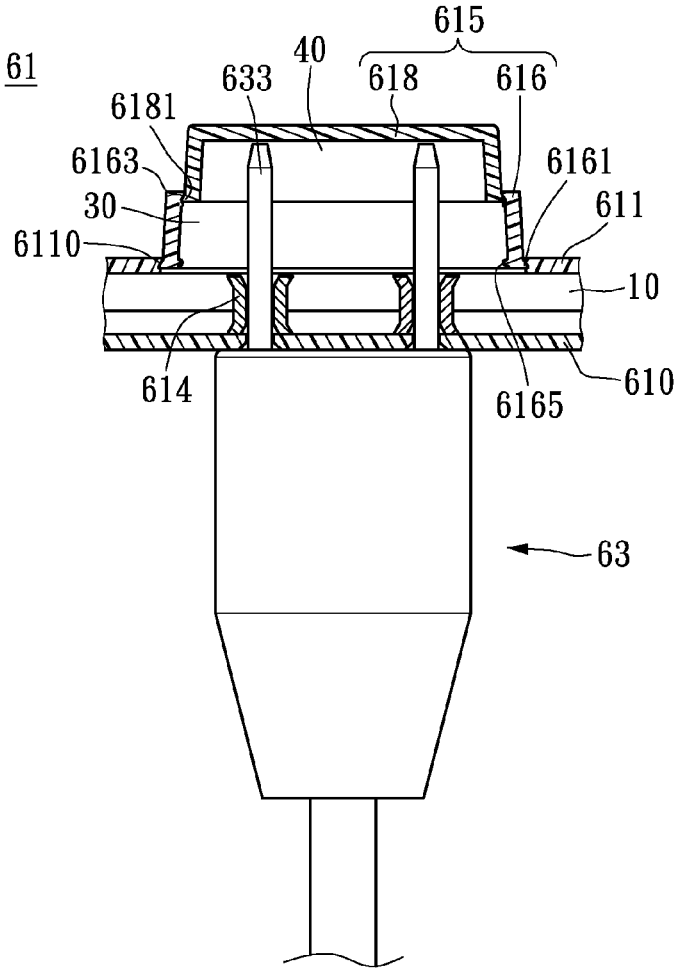

Refer subsequently to FIGS. 6A to 6B, wherein cross-section views for a fourth embodiment of the thin socket according to the present invention are shown. As depicted in FIG. 6A, the thin socket 61 in the fourth embodiment is generally similar to the thin socket 31 illustrated in the first embodiment; in other word, the thin socket 61 comprises a first case 610, a second case 611, a plurality of metal clamping parts 614 and a movable part 615. The difference between them is that the movable part 615 includes a cover 618 and a sleeve 616, and the movable part 615 can protrude out of the opening 6110 of the second case 611 in a multi-sectioned fashion.

The exterior periphery on the bottom side of the sleeve 616 is configured with a blocking portion 6161, the interior periphery of the sleeve 616 includes an inner flange 6163, and the inside of the sleeve 616 provides a third accommodating space 30. Meanwhile, the periphery on the bottom side of the cover 618 is configured with an outer flange 6181, and the inside of the cover 618 offers a fourth accommodating space 40.

The sleeve 616 is allowed to be movably embedded into the first accommodating space 10 or else protrudes out of the opening 6110, and the blocking portion 6161 can be located within the first accommodating space 10 along with the motion of the sleeve 616 and blocked on the second case 611 or the first case 610. The cover 618 is allowed to be movably accommodated within the third accommodating space 30 or protrude from the sleeve 616, with the outer flange 6181 moving along with the cover 618, located inside the third accommodating space 30 and blocked on the inner flange 6163 or the first case 610.

In the present embodiment, the interior side of the sleeve 616 may be also configured with a positioning portion 6165 which can be a bump or a positioning hole, and in case that the cover 618 is accommodated within the third accommodating space 30, the positioning portion 6165 can be used to temporarily clip the outer flange 6181 such that the cover 618 becomes fixedly embedded into the sleeve 616.

In the present embodiment, the thin socket 61 can further comprise at least one elastic component (not shown), wherein a first elastic component can be installed between the blocking portion 6161 and the second case 611, and a second elastic component can be installed between the outer flange 6181 and the inner flange 6163. Similarly, the first elastic component can be also installed between the blocking portion 6161 and the first case 610, and the second case can be installed between the outer flange 6181 and the first case 610, in which the operations of such first elastic component, second elastic component and movable part 615 can be referred to the first embodiment.

In practice, the number of the sleeve 616 is not limited; that is, the movable part 615 may ascend/descend out of the opening 6110 in a multi-sectioned fashion, and the use of the elastic components can be performed in conjunction with the number of the sleeve 616, while those skilled ones in the art can devise suitable approaches for specific applications based on modifications of the aforementioned examples.

Fifth Embodiment

Figure 7A:
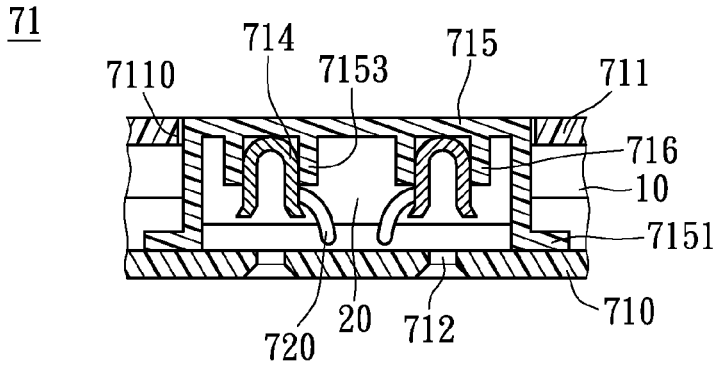
FIGS. 7A to 7B show cross-section views for a fifth embodiment of the thin socket according to the present invention.
Figure 7B:
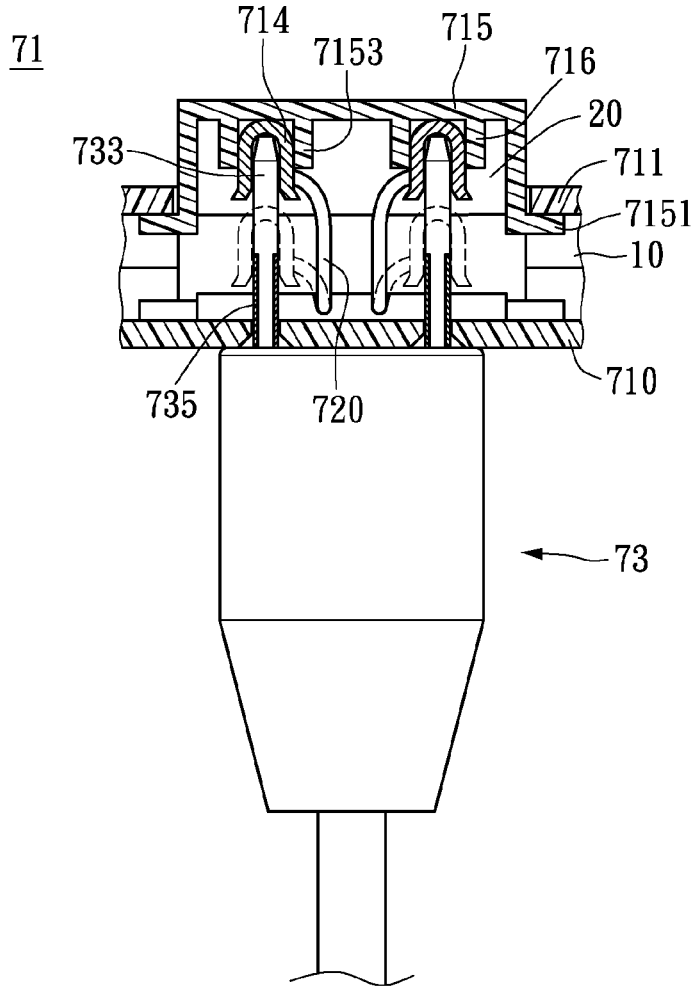

Refer now to FIGS. 7A to 7B, wherein cross-section views for a fifth embodiment of the thin socket according to the present invention are shown. As depicted in FIG. 7A, the thin socket 71 in the fifth embodiment is generally similar to the thin socket 31 illustrated in the first embodiment; in other word, the thin socket 71 comprises a first case 710, a second case 711, a plurality of metal clamping parts 714 and a movable part 715. The difference between them is in that the plurality of metal clamping parts 714 are installed on the movable part 715.

The holes 712 in the first case 710 are particularly applicable to a plug 73 which includes an insulating layer 735 and is installed on the bottom side of the conductive terminals 733; accordingly, the metal clamping parts 714 are installed on the movable part 715 and the position of the metal clamping parts 714 on the movable part 715 corresponds to the position of the holes 712 in the first case 710.

In practice, the interior side of the movable part 715 is installed with an accommodating portion 7153, in which the metal clamping parts 714 are attached into the accommodating portion 7153 by means of welding or adhesion and electrically connected to the power source input interface via a conductive line 720.

As shown in FIG. 7A, in case that the conductive terminals 733 of the plug 73 are not inserted in the holes 712, the movable part 715 is received within the first space 10.

On the other hand, as shown in FIG. 7B, suppose the conductive terminals 733 pass through the holes 712 and reach and press against the metal clamping parts 714, then the conductive terminals 733 can be fixedly held by the metal clamping parts 714, thus allowing the movable part 715 to protrude out of the opening 7110; meanwhile, the blocking portion 7151 is clipped to the second case 711, the second accommodating space 20 and the first accommodating space 10 becomes connected, and thus the conductive terminals 733 can be entirely received within the first accommodating space 10 and the second accommodating space 20.

In practice, the thin socket 71 can further comprise the elastic component or bumps set forth in the first to third embodiments, and can also apply the multi-sectioned movable part as described in the fourth embodiment.

Sixth Embodiment

Figure 8A:
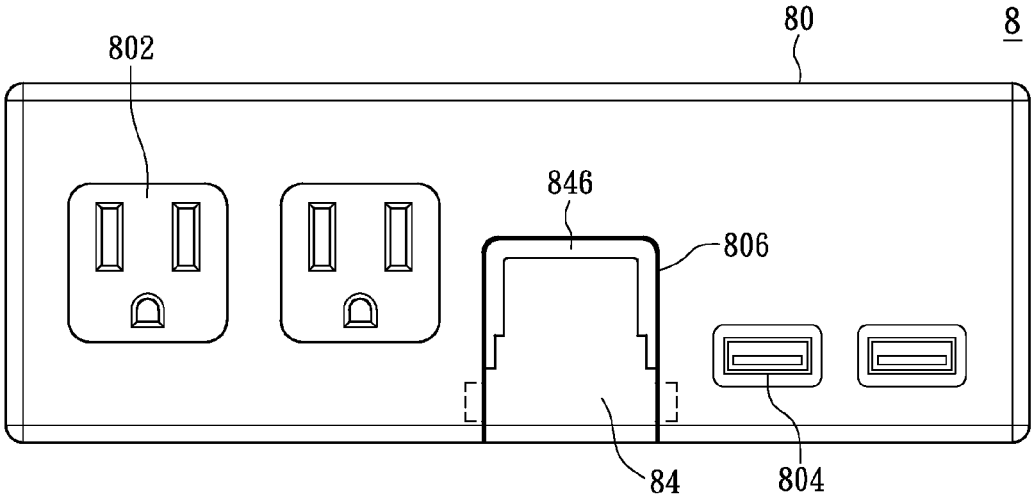
FIG. 8A shows a front view for an embodiment of the thin socket according to the present invention.
Figure 8B:
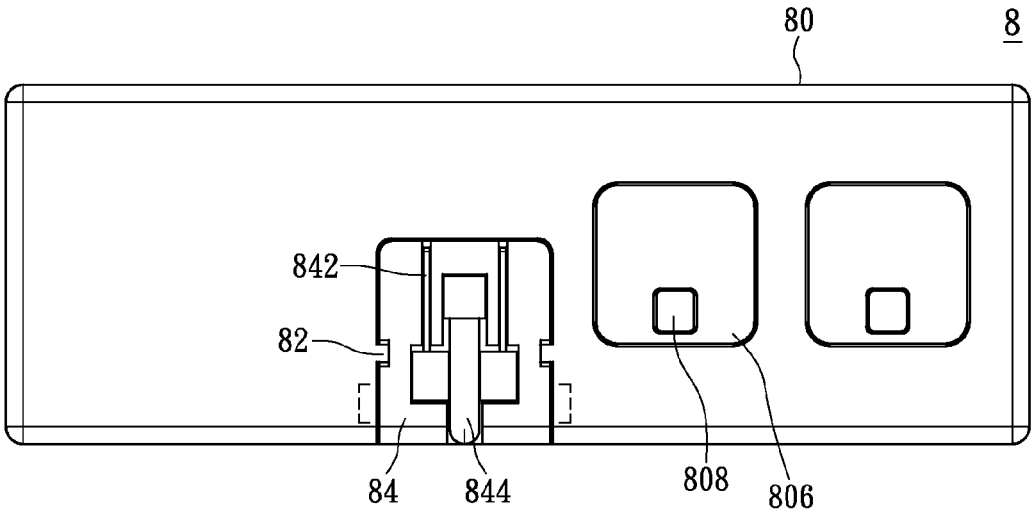
FIG. 8B shows a back view for an embodiment of the thin socket according to the present invention.
Figure 8C:
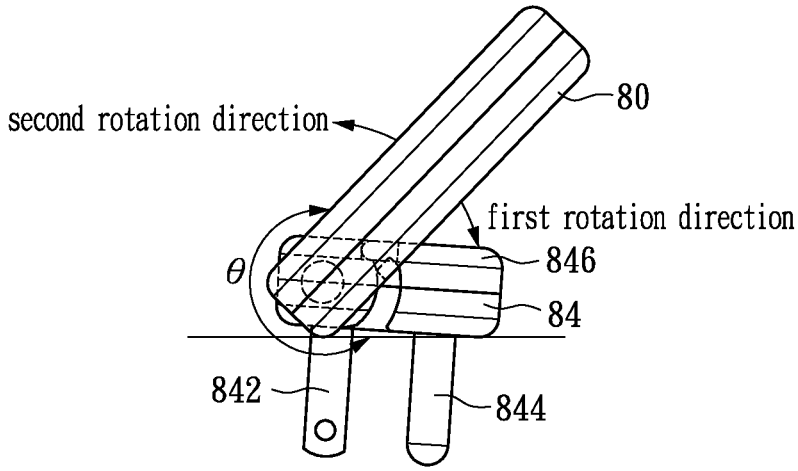
FIG. 8C to FIG. 8D shows a side view for an embodiment of the thin socket according to the present invention.

Refer now to FIGS. 8A, 8B, and 8C, FIG. 8A shows a front view for an embodiment of the thin socket according to the present invention. FIG. 8B shows a back view for an embodiment of the thin socket according to the present invention. FIG. 8C shows a side view for an embodiment of the thin socket when the thin socket is folded according to the present invention. As shown in figures, the thin socket 8 includes a body portion 80, a blocking member 82, and a rotatable plug 84. The body portion 80 can be formed by the first case and the second case mentioned in previous embodiments. For example, the body portion 80 can have several sockets 802 and USB ports 804 on a front surface (as depicted in FIG. 8A), and have several movable parts 806, 808 on a back surface (as depicted in FIG. 8B).

Take FIGS. 8A and 8B as example figures when the rotatable plug 84 is in an initial state. In the initial state, the rotatable plug 84 is accommodated inside the depression 806 of the body portion 80 and blocked by the blocking member 82 along a first rotation direction. When the rotatable plug 84 rotates a preset angle θ from the initial state, the rotatable plug 84 is blocked by the blocking member 82 along a second rotation direction. In practice, the preset angle θ is within a range between 90 degree and 315 degree. Preferably, the preset angle θ is 270 degree.

Referring to FIG. 8C, said first rotation direction means the blocking member 82 is clockwise rotated, and said second rotation direction means the blocking member 82 is counterclockwise rotated. To be noted, conductive terminals 842 and the ground terminal 844 of the rotatable plug 84 are able to be folded into corresponding recesses, so that the rotatable plug 84 and the body portion 80 can form a coplanar front surface and a coplanar back surface in the initial state.

Moreover, the rotatable plug 84 can further have an auxiliary handle 846, and the auxiliary handle 846 is configured to be pulled by user for extracting the rotatable plug 84 from an outlet. For example, the auxiliary handle 846 is formed in C-shaped, both ends of the auxiliary handle 846 are rotatably connected to the rotatable plug 84, and the auxiliary handle 846 is folded around the peripheral of the rotatable plug 84 when the auxiliary handle 846 is yet to be operated by user. In practice, the auxiliary handle 846 can be folded into a recess on the front surface of the rotatable plug 84 (as depicted in FIG. 8A), and the recess particularly can be formed on boundary of the rotatable plug 84.

Figure 8D:
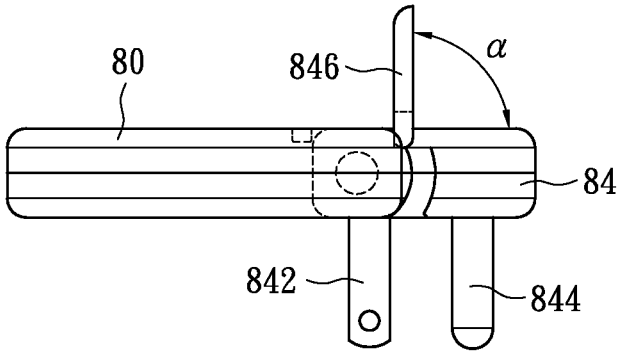

Referring to FIG. 8D, when user is going to pull those conductive terminals 842 and the ground terminal 844 out of the outlet on a wall, it is convenient that user can push the body portion 80 toward the wall (in order to have enough space for rotating the auxiliary handle 846), and lift up/rotate the auxiliary handle 846 by a pulling angle α with respect to the front surface of the rotatable plug 84. Thus, user can extract the rotatable plug 84 from an outlet by pulling the auxiliary handle 846.

To be noted, for those skilled in the art can realize that the present invention does not limit the auxiliary handle to be a C-shaped handle, the auxiliary handle can be modified in accordance with designer's need. For example, the auxiliary handle can have a button and a spring (not shown in figures), one end of the spring is connected to the bottom of an auxiliary recess on the front surface of the rotatable plug 84, the button is connected to the other end of the spring. In practice, the spring is compressed and hold inside the auxiliary recess when the auxiliary handle is yet to be operated by user, and the rotatable plug 84 and the button connected to the spring form a coplanar front surface. When user is going to pull those conductive terminals 842 and the ground terminal 844 out of the outlet on a wall, it is convenient that user can push the body portion 80 toward the wall (in order to have enough space for pop out the button connected to the spring), and release the compressed spring to elevate the button. Thus, user can extract the rotatable plug 84 from an outlet by pulling the exposed button.

Possible Effects of Embodiments

In accordance with the embodiments of the present invention, the thin socket as illustrated hereinbefore, through the ascending/descending movable part, can provide many advantageous features such as convenient accommodation, handy portability, protection for conductive terminals inserted into the holes thereby conforming to regulations on safe use of electric power, to name a few.

The aforementioned descriptions illustrate merely the embodiments of the present invention rather than limiting the claimed scope of the present invention thereto.

What is claimed is:

1. A thin socket enabling reception of a power source through a power source input interface, comprising:

a first case, having a plurality of holes used for insertion of a plurality of conductive terminals in a plug;

a second case, connected to the first case thereby forming a first accommodating space, wherein the second case has an opening whose position on the second case corresponds to the position of the plurality of holes on the first case;

a plurality of metal clamping parts, installed on the interior side of the first case and adjacent to such holes thereby clamping the conductive terminals passing through such holes, in which such metal clamping parts are respectively coupled to the power source input interface; and a movable part, movably embedded in the first accommodating space or protruding out of the opening, when such conductive terminals are respectively inserted into the holes, the conductive terminals reach and press against the movable part such that the movable part protrudes out of the opening.

2. The thin socket according to claim 1, wherein a blocking portion is configured on the exterior periphery of the movable part and the outer diameter of the blocking portion is greater than the size of the opening, such that the blocking portion moves along with the movable part, located within the first accommodating space and blocked by the second case.

3. The thin socket according to claim 2, further comprising an elastic component installed between the blocking portion and the second case or alternatively installed between the blocking portion and the first case, thereby that when such conductive terminals are unplugged from the holes, the elastic component provides a restoring force to allow the movable part to return to the inside of the first accommodating space.

4. The thin socket according to claim 1, wherein the movable part has a second accommodating space, and when such conductive terminals are respectively inserted into the holes, the second accommodating space and the first accommodating space are connected and such conductive terminals are accommodated within the first accommodating space and the second accommodating space.

5. The thin socket according to claim 4, wherein the movable part has a cover and a sleeve, the sleeve has a third accommodating space and the cover has a fourth accommodating space, in which the sleeve is movably embedded into the first accommodating space or protrudes out of the opening and the cover is movably embedded into the third accommodating space or protrudes out of the sleeve, thereby that when the conductive terminals are respectively inserted into the holes, the cover protrudes out of the sleeve and the sleeve protrudes out of the opening, and that the fourth accommodating space is connected to the third accommodating space, the third accommodating space is connected to the first accommodating space and such conductive terminals are accommodated within the first accommodating space, the third accommodating space as well as the fourth accommodating space.

6. The thin socket according to claim 5, wherein a blocking portion is installed on the exterior periphery of the sleeve, an inner flange is installed on the interior periphery of the sleeve and the cover has an outer flange, in which the exterior diameter of the blocking portion is greater than the size of the opening, and the blocking portion moves along with the sleeve within the first accommodating space, thus blocked on the second case, and the outer flange moves along with the cover within the third accommodating space, thus blocked on the inner flange.

7. The thin socket according to claim 1, wherein a blocking portion and a plurality of bumps are installed on the exterior periphery of the movable part, in which the exterior diameter of the blocking portion is greater than the size of the opening, the blocking portion is within the first accommodating space and blocked on the second case, and in case that the movable part is embedded into the first accommodating space or protrudes out of the opening, such bumps are respectively clipped on the second case.

8. A thin socket receiving a power source through a power source input interface, comprises:

a first case, having a plurality of holes used for insertion of a plurality of conductive terminals and a ground terminal in a plug;

a second case, connected to the first case thereby forming a first accommodating space, wherein the second case has an opening whose position on the second case corresponds to the position of the plurality of holes on the first case;

a movable part, movably embedded into the first accommodating space or protruding out of the opening; and a plurality of metal clamping parts, installed on the internal side of the movable part, in which the position where the plurality of metal clamping parts are installed on the movable part corresponds to the position of the holes installed on the first case, such plurality of metal clamping parts being respectively coupled to the power source input interface;

when the conductive terminals and the ground terminal are respectively inserted in the holes, the ground terminal reaches and presses against the movable part such that the movable part protrudes out of the opening, and the conductive terminals and the ground terminal are respectively clamped by such metal clamping parts.

9. The thin socket according to claim 8, wherein a blocking portion is configured on the exterior periphery of the movable part and the outer diameter of the blocking portion is greater than the size of the opening, such that the blocking portion moves along with the movable part, located within the first accommodating space and blocked by the second case.

10. The thin socket according to claim 9, further comprising an elastic component installed between the blocking portion and the second case or alternatively installed between the blocking portion and the first case, thereby that when such conductive terminals are unplugged from the holes, the elastic component provides a restoring force to allow the movable part to return to the inside of the first accommodating space.

11. A conductive device, comprising:

a body portion, having a first surface and a second surface, as well as an accommodating space surrounded by the first surface and the second surface for receiving a conductive component;

a hole portion, formed on the first surface of the body portion in order to allow a plug to be electrically connected to the conductive component through the hole portion; and a movable part, movably embedded in the portion, in which when the plug is inserted into the first surface and passes through the second surface, the plug reaches and presses against the movable part such that the movable part protrudes out of the second surface of the body portion.

12. A conductive device, comprising:

a body portion having a first surface and a second surface, a plurality of sockets disposed on the first surface, and a movable part movably embedded in the body portion, wherein when a plug is inserted into the first surface and passes through the second surface, the plug reaches and presses against the movable part such that the movable part protrudes out of the second surface of the body portion;

a blocking member disposed on a sidewall of a depression of the body portion;

a rotatable plug, rotatably connected to a rod fixed in the depression of the body portion, having a set of conductive terminals for plugging into a outlet and transmitting electric power to the sockets;

wherein the rotatable plug in an initial state is accommodated inside the depression of the body portion and blocked by the blocking member along a first rotation direction, when the rotatable plug rotates a preset angle from the initial state, the rotatable plug is blocked by the blocking member along a second rotation direction.

13. The conductive device according to claim 12, wherein the rotatable plug has a third surface and a fourth surface, the plurality of conductive terminals are disposed on the fourth surface, and the conductive terminals are able to be folded into corresponding recesses on the fourth surface.

14. The conductive device according to claim 13, wherein the first surface and the third surface are substantially in coplanar fashion in the initial state, and the second surface and the fourth surface are also substantially in coplanar fashion in the initial state.

15. The conductive device according to claim 13, further comprising:

an auxiliary handle, disposed on the third surface of the rotatable plug, for selectively being elevated from the third surface;

wherein the auxiliary handle elevated from the third surface is configured to be pulled by user for extracting the rotatable plug from the outlet.

16. The conductive device according to claim 15, wherein the auxiliary handle is formed in C-shaped, both ends of the auxiliary handle are rotatably connected to the rotatable plug, the auxiliary handle is folded around the peripheral of the rotatable plug when the auxiliary handle is yet to be operated by user, and the auxiliary handle is rotated by a pulling angle with respect to the third surface of the rotatable plug when the auxiliary handle is operated by user.

17. The conductive device according to claim 15, wherein the auxiliary handle comprises a button and a spring, one end of the spring is connected to the bottom of an auxiliary recess on the third surface, the button is connected to the other end of the spring, the auxiliary handle is hold inside the auxiliary recess when the auxiliary handle is yet to be operated by user, and the auxiliary handle is elevated from the third surface of the rotatable plug when the auxiliary handle is operated by user.

18. The conductive device according to claim 12, wherein the preset angle is within a range between 90 degree and 315 degree.

19. The conductive device according to claim 18, wherein the preset angle is 270 degree.

* * * * *